US005228876A

United States Patent [19]

Woods

[11] Patent Number: 5,228,876

[45] Date of Patent: Jul. 20, 1993

[54] MARINE EXHAUST SYSTEM COMPONENT

[76] Inventor: Woodrow E. Woods, 3640-D Fiscal Ct., Riviera Beach, Fla. 33404

[21] Appl. No.: 712,063

[22] Filed: Jun. 7, 1991

[51] Int. Cl.[5] ..... B63H 21/32

[52] U.S. Cl. ..... 440/89; 440/112; 277/212 FB; 60/323

[58] Field of Search ..... 440/88, 89, 112; 277/212 FB; 285/226-228; 60/323, 322

[56] References Cited

U.S. PATENT DOCUMENTS

| | | | |
|---|---|---|---|
| 3,061,565 | 10/1962 | Collings . | |
| 3,137,670 | 6/1964 | Maneri . | |
| 3,142,655 | 7/1964 | Bobear . | |
| 3,377,312 | 4/1968 | Baney . | |
| 3,514,424 | 5/1970 | Noble et al. . | |
| 3,539,530 | 11/1970 | Karstedt . | |
| 3,642,488 | 2/1972 | Watchorn et al. . | |
| 3,810,925 | 5/1974 | Viksne . | |
| 3,862,081 | 1/1975 | Itoh et al. . | |
| 3,862,082 | 1/1975 | Hatanaka et al. . | |
| 3,868,346 | 2/1975 | Merrill . | |
| 3,884,950 | 5/1975 | Koda et al. . | |
| 3,891,599 | 6/1975 | Marciniak et al. . | |
| 3,936,476 | 2/1976 | Itoh et al. . | |
| 3,991,011 | 11/1976 | Marciniak et al. . | |
| 3,996,188 | 12/1976 | Laur . | |
| 4,025,485 | 5/1977 | Kodama et al. . | |
| 4,198,494 | 4/1980 | Burckel . | |
| 4,677,141 | 6/1987 | Cornelius et al. . | |
| 4,753,619 | 6/1988 | Sullivan | 440/112 |
| 4,824,903 | 4/1989 | Aizawa et al. . | |

FOREIGN PATENT DOCUMENTS

| | | |
|---|---|---|
| 1161052 | 8/1969 | United Kingdom . |
| 1321700 | 6/1971 | United Kingdom . |

OTHER PUBLICATIONS

*Silicon Chemistry and Applications,* C. A. Pearce, Jan. 1972 pp. 63-69.

*Silicon Elastomer Developments 1967-1977,* Rubber Chemistry Technology, vol. 52, No. 3, Jul.-Aug. 1979, pp. 487-489.

*Primary Examiner*—Jesûs D. Sotelo

*Attorney, Agent, or Firm*—Malin, Haley, DiMaggio & Crosby

[57] ABSTRACT

A marine exhaust system component includes a flexible silicone rubber conduit adapted for installation particularly between the engine and exhaust conduit. Heat resistant fibers are impregnated in the silicone rubber to add mechanical strength to the conduit Additional heat resistant compounds can be impregnated in the silicone rubber to improve the heat resistance of the conduit. The conduit is able to withstand operating temperatures of about 350° F., and will survive intermittent temperatures of about 800°-1200° F. during engine malfunctions. The flexible silicone rubber conduit will substantially eliminate damage to the exhaust system caused by vibration and wrenching of the engine components during operation.

10 Claims, 2 Drawing Sheets

MARINE EXHAUST SYSTEM COMPONENT

BACKGROUND OF THE INVENTION

1. Field of the Invention

This invention relates generally to marine exhaust systems, and more particularly to conduits for marine exhaust systems.

2. Description of the Prior Art

Marine exhaust systems for large marine engines offer particular engineering challenges due to a combination of close quarters, large engine size, high operating exhaust temperatures, vibration stresses, and the aquatic environment and associated humidity. Of particular concern is the connection between the engine proper, and particularly the turbo charger, and the exhaust riser that is provided to carry the exhaust away from the engine and expel these fumes into the water or surrounding atmosphere. This point of connection is susceptible to stress damage given the vibration of the engine and the wrenching effects that often occur during engine operation.

It would be desirable to provide a connection between the engine and the exhaust conduit system of marine vessels which would substantially prevent vibration damage and damage from the effects of wrenching during engine operation. The connection must be resistant to high temperatures, as large marine engines can operate at exhaust temperatures of approximately 350° F. Additionally, such connection must be able to withstand intermittent temperatures of 800° F. or more, which temperatures can be attained during periods of engine malfunction.

SUMMARY OF THE INVENTION

It is an object of the invention to provide a connection between a marine engine and an exhaust conduit of the engine which will substantially prevent vibration damage and damage from the effects of wrenching during engine operation.

It is another object of the invention to provide a connection which will withstand operating temperatures of approximately 350° F.

It is yet another object of the invention to provide a connection which is capable of withstanding intermittent temperatures of 800° F. or more.

It is another object of the invention to provide a connection which is relatively inexpensive to manufacture.

It is still another object of the invention to provide a connection which is capable of installation in tight quarters and in a variety of different marine engines.

These and other objects are accomplished by a connection for marine exhaust systems which comprises a flexible conduit of silicone rubber. Heat resistant fibers are impregnated in or otherwise combined with the silicone rubber to add mechanical strength to the silicone rubber conduit.

The heat resistant fibers can be selected from a number of fibers known for mechanical strength and heat resistance. These can include normally flammable fibers such as cotton, dacron, and rayon which have been treated with known flame-resistant surface coating compositions. Also, flammable fibers can be spun with polymers which are inherently flame-resistant, such as polyvinylchloride, polytetrafluoroethylene, and polymetaphenylene-isophthalamide, to impart flame resistance. Additionally, inorganic compounds such as asbestos, fiberglass, and aluminum silicate could also be suitable. Heat resistant fibers have particularly good flexibility including those made from compounds such as polybenzimidazoles, polyoxadiazoles, polyparaphenylene terephthalamide and known heat-treated/cyclized acrylics. More recently, U.S. Pat. No. 4,198,494 describes a fiber blend of poly(m-phenylene isophthalamide) and poly(p-phenylene terephthalamide). This material, known under the trademark Nomex®, is currently available from the E. I. Du Pont de Nemours and Company of Wilmington, Del.

Compounds can be impregnated into the silicone rubber to impart additional heat resistance. One known compound is iron oxide, although additional compounds are also possible.

The flexible conduit of the invention is preferably manufactured in plies, which plies impart both mechanical strength and tear resistance to the finished product. Plies of silicone rubber, which can have selected materials impregnated therein, are wound about a central core and calendared to produce the final structure. Inner plies will preferably have fibers of high heat resistance impregnated therein, as the inner portions of the conduit will suffer the most exposure to high heat flux. Outer layers of less expensive fiber, which materials do not have the heat resistance of the more expensive heat resistant fibers, can be provided to impart mechanical strength to the conduit.

BRIEF DESCRIPTION OF THE DRAWINGS

There are shown the drawings embodiments which are presently preferred, it being understood, however, that the invention is not limited to the precise arrangements and instrumentalities shown, wherein.

DETAILED DESCRIPTION OF THE PREFERRED EMBODIMENT

Figure 2:
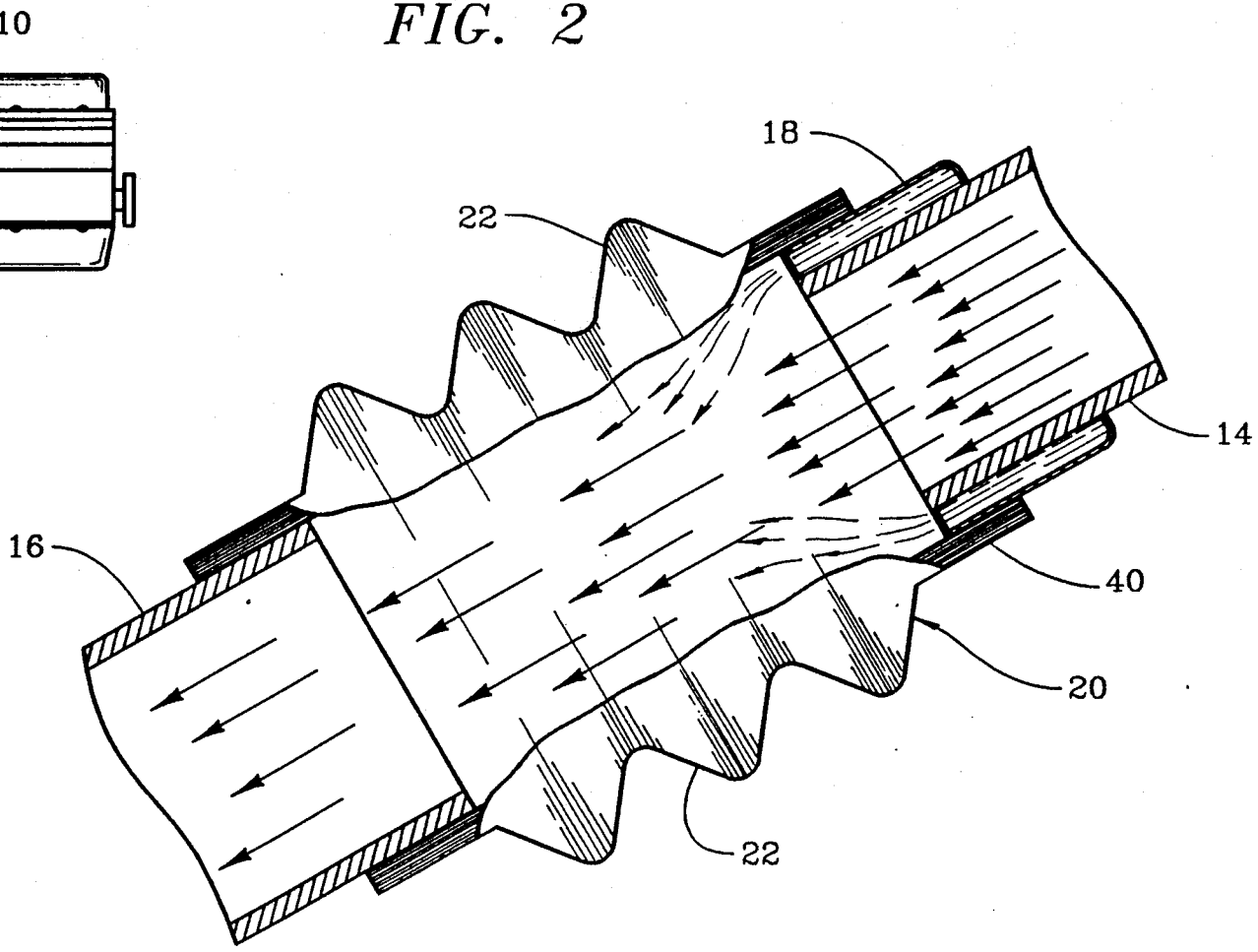
FIG. 2 is a side elevation of the component, partially broken away to depict internal features.
Figure 1:
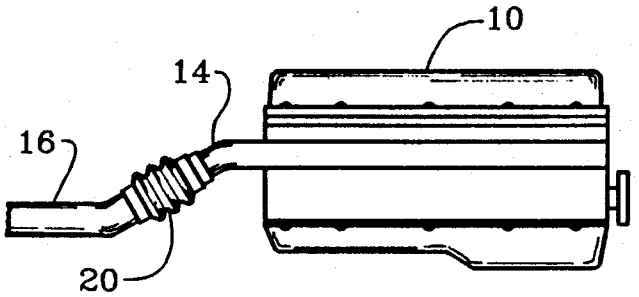
FIG. 1 is a side elevation depicting an installation of a component according to the invention in a marine engine exhaust system.

There is shown in the drawings a marine engine 10 which generates exhaust fumes which are carried through an engine exhaust system conduit 14 to an exhaust pipe such as the exhaust riser 16 having an exhaust opening from which the fumes are emitted to the water or surrounding atmosphere. A water-injection device 18 is often provided to inject cooling water directly into the exhaust gas stream. A flexible conduit 20 is adapted for installation between the exhaust conduit 14 and the exhaust riser 16. The conduit 20 comprises a silicone rubber which is flexible and very durable in harsh environments such as that presented by very hot exhaust gases and the humidity of the marine environment. Bellows 22 can be formed on the conduit 20 to improve the strength and flexibility characteristics of the conduit 20. Heat resistant fibers are impregnated in the silicone rubber conduit to impart mechanical strength.

The heat resistant fibers that are impregnated in the conduit 20 can be selected from a number of suitable materials known for heat resistance and mechanical strength. It is preferable that the fibers also be flexible. The fibers can be dispersed in the silicone in many ways, but preferably each fiber material is provided as a fabric. A preferred fiber is the Nomex® fiber manufactured by the E. I. Du Pont de Nemours and Company of Wilmington, Del., as described in Burckel (deceased), U.S. Pat. No. 4,198,494. The disclosure of this reference is hereby incorporated fully by reference. Nomex® comprises a blend of poly(m-phenylene isophthalamide) and poly(p-phenylene terephthalamide) fibers. The product has high heat resistance, and exhibits a flame strength of at least 20 mg./den. for at least ten seconds during exposure to a heat flux of 2 cal./cm.$^2$/sec. Other high temperature organic polymeric fibers are also known for this purpose, including polybenzimidazoles, polyoxadiazoles, polyparaphenylene terephthalamide and certain heat-treated/cyclized acrylics. Other possible fibers include treated flammable fibers such as cotton, dacron, and rayon, which can be coated with flame resistant coating compositions. Also, flammable synthetic fibers, such as rayon, polyolefins, polyesters, and acrylics, can be spun with flame retardant additives or other synthetic fibers which are spun from polymers which are inherently flame resistant, such as polyvinylchloride, polytetrafluoroethylene, and polymetaphenylene-isophthalamide. Also, inorganic fibrous materials, such as asbestos, fiberglass, and various ceramic materials such as aluminum silicate are known for resistance to heat and flame. These compounds can be brittle and suffer from rapid loss of strength, shrinkage, or rapid break open on an exposure to intense heat fluxes.

Compounds can be impregnated in the silicone rubber to impart additional heat resistance. A preferred compound is iron oxide, although additional compounds are also possible. Suitable additives to impact heat resistance to silicone rubbers are described by Warrick, et al in *Rubber Chemistry and Technology*, Vol. 52, No. 3, July–August 1979, the disclosure of which is hereby incorporated by reference. There are disclosed three principle classes of additives which impart heat resistance to silicone rubbers, metals and their derivatives, particulate additives, and organic antioxidants. Trivalent iron compounds are the most common of the metals, although transition-metal and rare-earth derivatives have also been evaluated. Particulate additives include silica and fused titanium dioxide. Organic antioxidants include phenazasilanes, azomethine bases and their complexes, and polymeric species resulting from the interaction of hydroquinone and diaminopyrene or diaminoanthraquinone.

Patents which disclose heat-resistant silicone rubbers include Collings, U.S. Pat. No. 3,061,565; Maneri, U.S. Pat. No. 3,137,670; Boebear, U.S. Pat. No. 3,142,655; Baney, U.S. Pat. No. 3,377,312; Nobel et al U.S. Pat. No. 3,514,424; Karstedt, U.S. Pat. No. 3,539,530; Viksne, U.S. Pat. No. 3,810,925; Itoh, et al, U.S. Pat. No. 3,862,081; Hatanka, et al, U.S. Pat. No. 3,862,082; Merrill, U.S. Pat. No. 3,868,346; Koda, et al, U.S. Pat. No. 3,884,950; Marciniak, U.S. Pat. No. 3,891,599; Itoh, et al, U.S. Pat. No. 3,936,476; Marciniak, U.S. Pat. No. 3,991,011; Laur, U.S. Pat. No. 3,996,188; Kodaman, et al, U.S. Pat. No. 4,025,485; Cornelius, et al, U.S. Pat. No. 4,677,141; Aizawa, et al, U.S. Pat. No. 4,824,903; Halewood, et al, British Pat. No. 1,321,700; and Harder, Bristish Pat. No. 1,161,052. The disclosures of these patents are fully incorporated by reference. It is also possible to coat the silicone rubber with compatible heat resistant materials.

The precise quantitative characteristics of the invention, such as the thickness of the conduit, the amount of heat resistant fibers and heat resistant compounds that are impregnated in the silicone, as well as the selection of the heat resistant fiber and any heat resistant compound, can be adjusted according to the installation requirements. The characteristics of the installation site include the temperature and chemistry of the exhaust gases, and the amount of vibration that is present.

Figure 3:
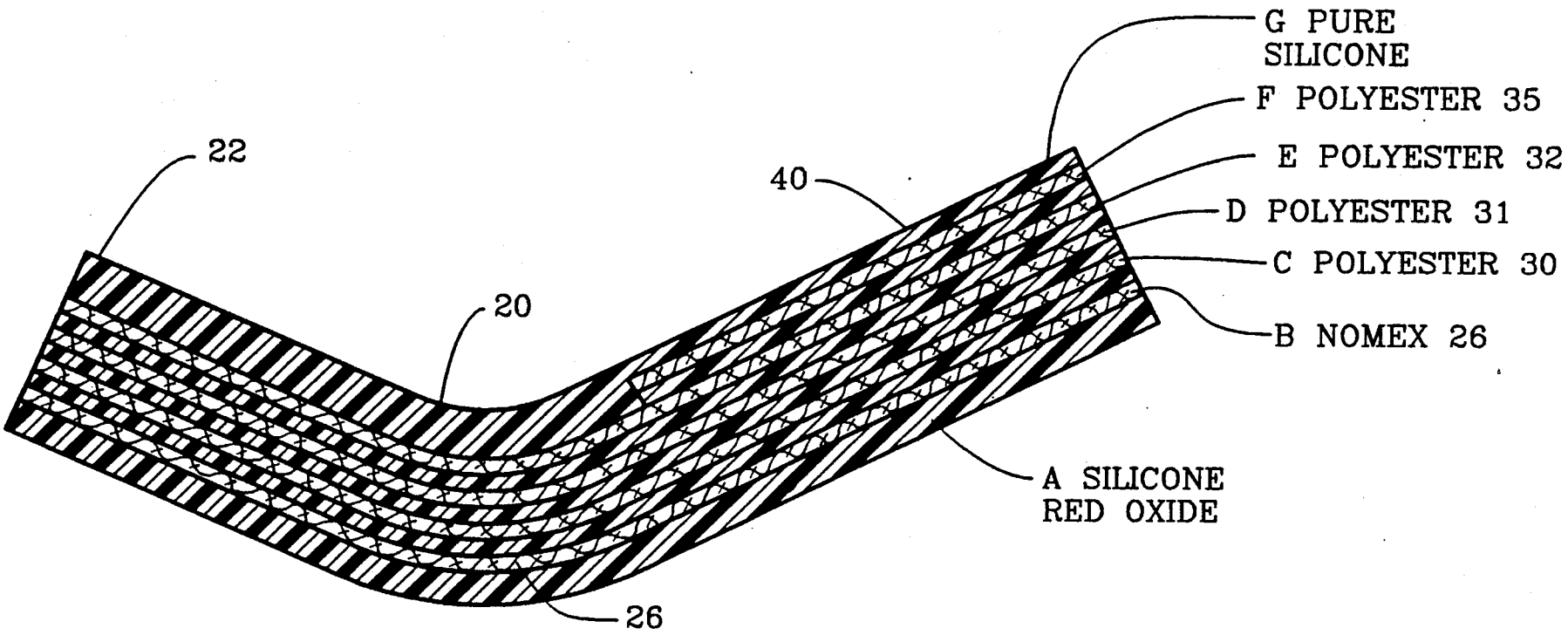
FIG. 3 is schematic cross-sectional representation of the component.

A preferred embodiment of the conduit of the invention is constructed of plies of silicone rubber, and is depicted particularly in FIG. 3. The plies permit a layered construction having selected materials impregnated in layers of silicone rubber, which layers can be wound together and joined by curing the silicon rubber to form a layered conduit construction. The plies provide mechanical strength and tear resistance to the conduit. The thickness of the plies can be varied. The heat resistant fibers and any heat resistant compounds can be impregnated in one or more of the plies to impart the desired mechanical strength and heat resistance to the finished product. Nomex® fibers and other flexible fibers having high heat resistance can be comparatively expensive relative to lower-cost fibers such as cotton, polyester, dacron, and rayon. It is currently preferred that Nomex® or other high heat resistance fibers be provided as an inner ply 26, which ply will be most susceptible to high heat flux. Lower cost polyester, cotton or rayon can be used in one or more outer plies, such as the plies 30–32, where a lower heat flux will be encountered. An additional ply 36 of strength-imparting fiber such as polyester can be provided in a cuff portion 40, which typically incurs additional stress as the location of connection to the exhaust system compounds such as the exhaust conduit 14 and exhaust pipe 16.

A preferred conduit having a wall thickness of approximately 250/1,000 of an inch will be described. The marine application needs greater wall thicknesses than other applications because of the sealing requirements in the marine environment. An inner silicone rubber ply containing iron oxide is approximately 90–125/1,000 of an inch in thickness. This is followed by an inner Nomex® ply comprising Nomex® fabric impregnated with silicone rubber and having a thickness of approximately 1–15/1,000 of an inch. Polyester, rayon, dacron, cotton or fiberglass plies of between about 5–50/1,000 of an inch, preferably also containing oxide, are provided around the Nomex® ply to provide additional mechanical strength. An outer-most silicone rubber ply, which may or may not include iron oxide, of approximately 20–30/1,000 of an inch, is applied to provide resistance to chafing and friction caused by hose clamps and other external items. The plies can be calendared about a core from which the finished conduit is later removed after the silicone rubber has cured. An outer layer of shrink wrapping can be provided to hold the plies together during curing, and is removed prior to use. Other methods of constructing the conduit are also possible.

The silicone rubberiron oxide inner ply provides excellent sealing at the connections while maintaining superior heat resistance. It is necessary that the conduit be able to withstand temperatures of about 800°–1,200° F. for intermittent periods, lasting at least about two minutes. The Nomex® ply provides maximum protection during intermittent overheating conditions which, for example, can be caused by an interruption in the flow of cooling water to the exhaust gases. The outer plies provide additional mechanical reinforcement which allows the conduit to withstand the pressures of the exhaust system gases. Nomex ® could alternatively be used in each ply, but at a greater expense.

The invention provides a method for sealably connecting the engine exhaust system to the exhaust pipe of a marine vessel. A flexible conduit according to the invention is placed between the engine exhaust system and the exhaust conduit and fastened in place with suitable clamps or other fastening structure. The flexible connection substantially eliminates the damaging effects of vibration during engine operation, and particularly those that occur at the turbo charger-exhaust riser connection, and the attendant exhaust leaks that are caused by this action. The flexible silicone can be molded into a variety of different shapes and sizes, and can be fitted into very tight quarters. The silicone rubber will withstand operating temperatures of about −65° F. to 400° F., and the invention is capable of withstanding intermittent temperatures over 800° F. without rupture or the creation of toxic fumes. The burned silicone rubber that results from exposure to high heat becomes brittle and can create an additional retardant to heat flux.

This invention can be embodied in other forms without departing from the spirit or essential attributes thereof, and accordingly, reference should be had to the following claims, rather than to the foregoing specification, as indicating the scope of the invention.

I claim:

1. A connection for installation between marine engines and exhaust conduits, comprising a flexible silicone rubber conduit having at least one heat resistant fiber material impregnated therein, said fiber being adapted to provide heat resistance and mechanical strength to said silicone rubber conduit.

2. The connection of claim 1, wherein said heat resistant fiber material is a blend of poly(m-phenylene isophthalamide) and poly(p-phenylene terephthalamide).

3. The connection of claim 1, wherein said heat resistant fiber material is selected from the group consisting of polybenzimidazoles, polyoxadiazoles and polyparaphenylene terephthalamide.

4. The connection of claim 1, wherein said heat resistant fiber material is selected from the group consisting of polybenzimidazoles; polyoxadiazoles; polyparaphenylene terephthalamide; heat-treated/cyclized acrylics; cotton, dacron, and rayon coated with flame resistant coating compositions; cotton, dacron, rayon, polyolefins, polyesters, and acrylics spun with flame retardant additives; cotton, dacron, rayon, pololefins, polyesters, and acrylics spun with flame resistant polymers; asbestos; fiberglass; and aluminum silicate.

5. The connection of claim 4, wherein said conduit comprises an innermost layer of silicone rubber impregnated with iron oxide, a next-outer layer of silicone rubber having a blend of poly(m-phenylene isophthalamide) and poly(p-phenylene terephthalamide) fibers, at least one outer layer of silicone rubber having fibers impregnated therein adapted to provide mechanical strength to said silicone rubber conduit, and an outermost layer of silicone rubber.

6. The connection of claim 5, wherein the thickness of the innermost layer is about 90–125/1,000 of an inch in thickness, said layer having fibers comprising a blend of poly(m-phenylene isophthalamide) and poly(p-phenylene terephthalamide) fibers is about 1–15/1,000 of an inch, said layers having fibers therein adapted to provide mechanical strength to said silicone rubber conduit layers are about 5–50/1,000 of an inch in thickness, and said outermost silicone rubber layer is about 20–30/1,000 of an inch.

7. The connection of claim 5, wherein said layers are provided as plies, said plies being calendared together to form said conduit prior to curing of said silicon rubber.

8. The connection of claim 1, further comprising a heat resistant compound impregnated in said silicone rubber.

9. A connection of claim 8, wherein said heat resistant compound is iron oxide.

10. The connection of claim 1, further comprising cuff portions at each end of said connection, said cuff portions comprising additional material impregnated in said silicone rubber and adapted to impart mechanical strength to said cuff portions.

* * * * *